US011162347B2

(12) United States Patent
Yu et al.

(10) Patent No.: US 11,162,347 B2
(45) Date of Patent: Nov. 2, 2021

(54) SLICK WATER VOLUMETRIC FRACTURING METHOD WITH LARGE LIQUID VOLUME, HIGH FLOW RATE, LARGE PREFLUSH AND LOW SAND RATIO

(71) Applicant: YANGTZE UNIVERSITY, Jingzhou (CN)

(72) Inventors: Weichu Yu, Jingzhou (CN); Dongkui Zhou, Jingzhou (CN); Ying Zhang, Jingzhou (CN); Xiangsong Xiao, Jingzhou (CN); Shanwen Yu, Jingzhou (CN)

(73) Assignee: YANGTZE UNIVERSITY, Jingzhou (CN)

( * ) Notice: Subject to any disclaimer, the term of this patent is extended or adjusted under 35 U.S.C. 154(b) by 29 days.

(21) Appl. No.: 16/672,468

(22) Filed: Nov. 3, 2019

(65) Prior Publication Data

US 2021/0108495 A1 Apr. 15, 2021

(30) Foreign Application Priority Data

Oct. 11, 2019 (CN) ..... 201910963449.0

(51) Int. Cl.

| | |
|---|---|
| ***E21B 43/267*** | (2006.01) |
| ***E21B 43/11*** | (2006.01) |
| ***E21B 49/00*** | (2006.01) |

(52) U.S. Cl.

CPC ..... *E21B 43/267* (2013.01); *E21B 43/11* (2013.01); *E21B 49/00* (2013.01)

(58) Field of Classification Search

CPC ..... E21B 43/267; E21B 49/00; E21B 43/11; E21B 47/00; G01N 33/241

See application file for complete search history.

(56) References Cited

U.S. PATENT DOCUMENTS

| | | | | |
|---|---|---|---|---|
| 9,771,795 | B2 * | 9/2017 | Knight | E21B 49/00 |
| 10,689,980 | B2 * | 6/2020 | Hsu | E21B 49/10 |
| 2019/0249523 | A1 * | 8/2019 | Moghanloo | E21B 49/005 |

FOREIGN PATENT DOCUMENTS

| | | | | |
|---|---|---|---|---|
| GB | 2258923 B | * | 10/1994 | E21B 49/006 |
| WO | WO-2020103414 A1 | * | 5/2020 | E21B 49/00 |

* cited by examiner

*Primary Examiner* — Nicole Coy

(74) *Attorney, Agent, or Firm* — Hemisphere Law, PLLC; Zhigang Ma

(57) ABSTRACT

Disclosed is slick water volumetric fracturing method with large liquid volume, high flow rate, large preflush and low sand ratio, including the following steps: (a) evaluating the reservoir parameters; (b) determining the perforation position and a perforation parameters of a fracturing interval; (c) determining the fracturing parameters; (d) performing a perforation operation on the fracturing interval; (e) injecting acidizing fluids into the perforation; (f) alternately injecting preflush and sand-laden fluids into the fracturing interval several times; (g) injecting displacement fluids into the fracturing interval; wherein the flow rate is not less than 12 $m^3$/min. The beneficial effect of the technical scheme proposed in the present invention is: by using a low viscosity slick water fracturing fluid with high flow rate, the pressure of the fracturing fluid is increased, thereby increasing the stimulated reservoir volume and increasing the fracturing yield.

7 Claims, 2 Drawing Sheets

SLICK WATER VOLUMETRIC FRACTURING METHOD WITH LARGE LIQUID VOLUME, HIGH FLOW RATE, LARGE PREFLUSH AND LOW SAND RATIO

FIELD OF THE DISCLOSURE

The disclosure relates to slick water volumetric fracturing method with large liquid volume, high flow rate, large preflush and low sand ratio

BACKGROUND

High sand ratio fracturing is a conventional fracturing technology, which is mainly used in the fracturing of oil and gas reservoirs with medium or high permeability. The purpose of high sand ratio fracturing is to form fractures with high conductivity, so as to achieve the purpose of communicating the originally isolated reservoirs and achieve the effect of increasing oil and gas production.

However, for unconventional reservoirs, especially tight reservoirs and shale reservoirs, although the conventional high sand ratio fracturing methods can form high-conductivity fractures, due to the extremely low permeability of unconventional reservoirs as well as their accumulation characteristics of self-generation and self-accumulation, the reservoir volume connected by high-diversion fractures is limited, which leads to low initial production after fracturing, rapid production decline, short stable production period and other problems.

In order to solve these problems, volume fracturing technology has been developed in recent years. The method of volume fracturing is fracturing one or more main fractures in fracturing transformation to communicate natural fractures and bedding, while fracturing secondary fractures in the lateral direction of the main fracture, and continuing to branch to form secondary fractures on the secondary fractures, so that the main fractures and the multi-level secondary fractures are interwoven to form a fracture network system, which greatly improves the overall permeability of the reservoir and achieves a comprehensive transformation of the reservoir in three dimensions. By extending the fracture network in the formation as far as possible to form complex fractures, industrial productivity can be realized. Therefore, the fracturing method of tight reservoir is different from the fracturing method of conventional oil reservoir. The more complicated the fracture network caused by the tight reservoir lamination, the larger the stimulated reservoir volume and the higher the production after fracturing. The stimulated reservoir volume should be increased as much as possible to maximize the affected volume.

At present, in the development of unconventional oil and gas reservoirs, a mixture of low-viscosity fracturing fluid and high-viscosity fracturing fluid is used, or low-viscosity fracturing fluid and high-viscosity fracturing are alternately used. The flow rate and the pressure are low, the fracture half length does not meet the design requirements and sand plug is easy to occur, as a result, it is difficult to form a complex network of sand-filling fractures, and the production increase is not effective.

SUMMARY

A technical problem to be solved by the disclosure is to provide a volumetric fracturing method that can increase the stimulated reservoir volume and enhance the effect of production increase.

Slick water volumetric fracturing method with large liquid volume, high flow rate, large preflush and low sand ratio, including the following steps:

(a) evaluating the reservoir parameters and determining the compressibility of the reservoir, and dividing the reservoir into several fracturing intervals when the reservoir is compressible;

(b) determining the perforation position and perforation parameters of a fracturing interval, wherein the perforation parameters include at least the cluster spacing, the number of clusters, the number of holes, and the perforation density;

(c) determining the fracturing parameters including flow rate and the injection volume of preflush, sand-laden fluid, and displacement fluid of each fracturing interval;

(d) performing a perforation operation on the fracturing interval based on the determined position of the perforation and the determined perforation parameters;

(e) injecting acidizing fluids into the perforation to acidify the perforation;

(f) alternately injecting preflush and sand-laden fluids into the fracturing interval several times to fracturing fractures and filling sand into the fractures;

(g) after the sand filling is completed, injecting displacement fluids into the fracturing interval to drive the sand-laden fluids in the wellbore into the fractures;

wherein the flow rate is not less than 12 $m^3$/min; the sand ratio of the sand-laden fluids is not more than 15%; the preflush and the displacement fluids are slick water fracturing fluids, and the sand-laden fluids are slick water fracturing fluids with proppant added; the amount of preflush injected is 30% to 50% of the total injection volume of the fracturing fluids.

The beneficial effect of the technical scheme proposed in the disclosure is: by using a low viscosity slick water fracturing fluid with high flow rate, the pressure of the fracturing fluid is increased, thereby increasing the stimulated reservoir volume and increasing the fracturing yield.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
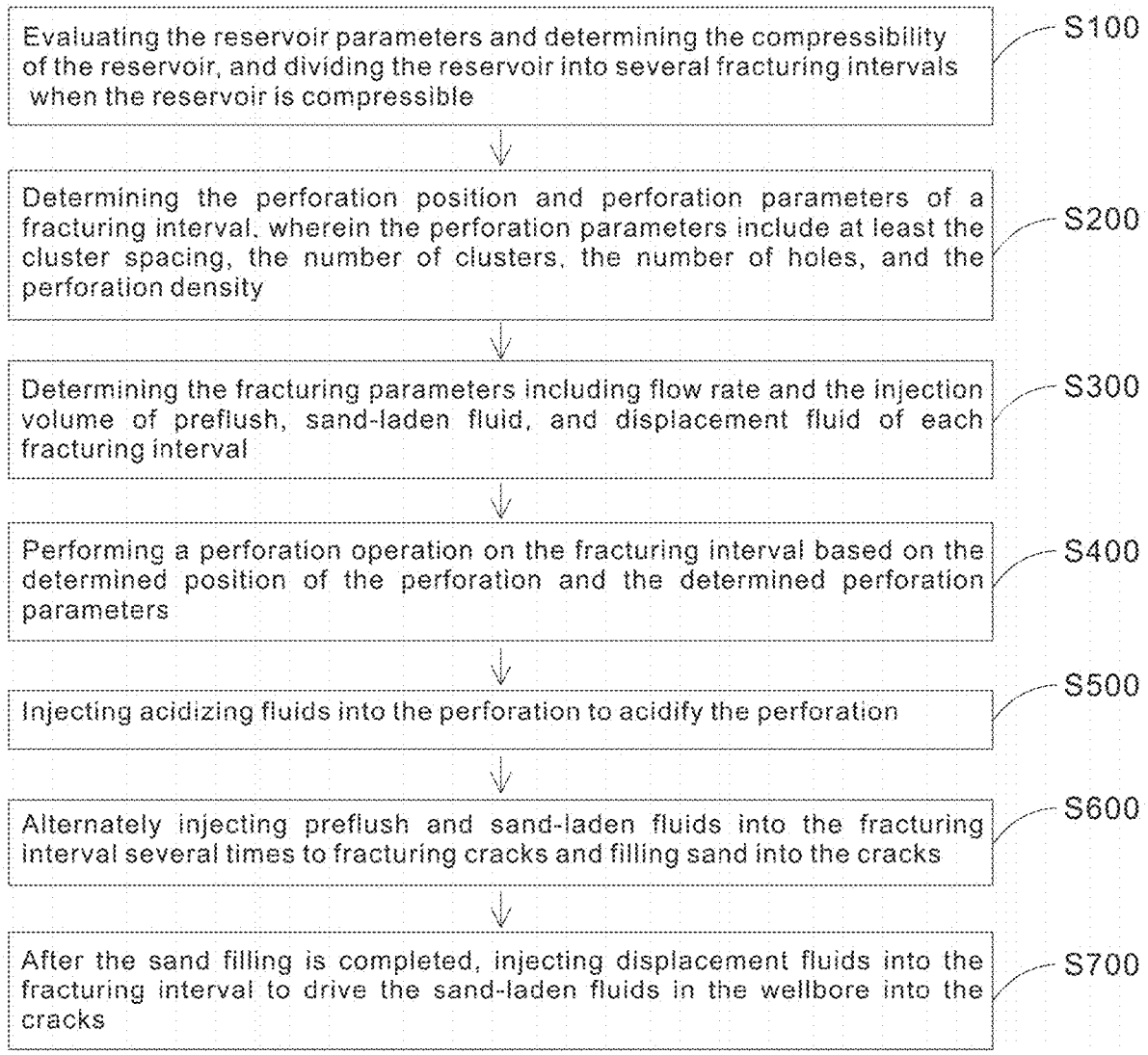
FIG. 1 is a schematic flow chart of slick water volume fracturing method.

In order to verify the feasibility of the present invention, a well in the eastern part of the Northern Shaanxi Slope of the Ordos Basin was selected as an example. The eastern part of the North Shaanxi Slope in the Ordos Basin is a typical low-permeability tight sandstone reservoir. Due to the poor physical properties of the reservoir, the conventional fracturing method is not ideal. Therefore, the fracturing method provided by the disclosure is used in this well. As illustrated in FIG. 1, the fracturing design and construction includes the following steps:

S100 Evaluating the reservoir parameters and determining the compressibility of the reservoir, and dividing the reservoir into several fracturing intervals when the reservoir is compressible, in this embodiment, the reservoir is divided into eight fracturing intervals;

S200 Determining the perforation position and perforation parameters of a fracturing interval, wherein the perforation parameters include at least the cluster spacing, the number of clusters, the number of holes, and the perforation density;

S300 Determining the fracturing parameters including flow rate and the injection volume of preflush, sand-laden fluid, and displacement fluid of each fracturing interval;

S400 Performing a perforation operation on the fracturing interval based on the determined position of the perforation and the determined perforation parameters;

S500 Injecting acidizing fluids into the perforation to acidify the perforation;

S600 Alternately injecting preflush and sand-laden fluids into the fracturing interval several times to fracturing fractures and filling sand into the fractures;

S700 After the sand filling is completed, injecting displacement fluids into the fracturing interval to drive the sand-laden fluids in the wellbore into the fractures;

Wherein the flow rate is not less than 12 $m^3$/min, and in this embodiment, the flow rate is 12 $m^3$/min; the sand ratio of the sand-laden fluids is not more than 15%, the pressure is less than 95 MPa to meet the requirement of forming complex fracture networks; the preflush and the displacement fluids are slick water fracturing fluids, and the sand-laden fluids are slick water fracturing fluids with proppant added. The formulation of the slick water is: 0.1% drag reducing agent+0.2% anti-swelling agent+0.2% cleanup additive+0.05% bactericide+99.45% water, the viscosity of slick water fracturing fluid system is 1.0~3.0 mPa·s; the amount of preflush injected is 30% to 50% of the total injection volume of the fracturing fluids. As illustrated in Table 1, the preflush proportion of the eight fracturing intervals are between 30% and 31%.

TABLE 1

The total amount of fracturing fluids and the proportion of preflush in each fracturing interval

| Fracturing Interval | Total Volume of Fracturing Fluid/$m^3$ | Volume of Preflush/$m^3$ | Preflush Proportion/% |
|---|---|---|---|
| Interval 1 | 1325 | 400 | 30 |
| Interval 2 | 1325 | 400 | 30 |
| Interval 3 | 1100 | 340 | 31 |
| Interval 4 | 1100 | 340 | 31 |
| Interval 5 | 1100 | 340 | 31 |
| Interval 6 | 1100 | 340 | 31 |
| Interval 7 | 880 | 264 | 30 |
| Interval 8 | 880 | 264 | 30 |
| Total | 8810 | 2688 | 31 |

The process of the slick water volumetric fracturing method provided by the disclosure is: a large amount of preflush is injected into the fracturing interval, and then the sand-laden fluid is injected into the fracturing interval. The proppant in the sand-laden fluid enters the fractures to prevent the fracture from closing, and finally the displacement fluid is injected into the fracturing interval to drive the sand-laden fluids in the wellbore into the fractures; Since the viscosity of the slick water fracturing fluid is low and flow rate is high, a larger stimulated reservoir volume can be formed than the conventional fracturing method, which is beneficial to achieve higher production of oil and gas.

Specifically, in the embodiment, the number of the fracturing intervals is eight. In other embodiments, the number of the fracturing intervals may also be other number, which is not restricted by this disclosure. In this embodiment, the interval spacing is 60~80 meters. The cluster spacing is 20 meters, the number of perforations per cluster is eight, the perforation density is eight holes per meter, and the flow rate of each hole is not less than 0.3 $m^3$/min, so a total of 40 holes is required to reach a flow rate of 12 $m^3$/min.

Preferably, the acidizing fluid is 15% hydrochloric acid with other additives, the flow rate of the acidizing fluid is 2 $m^3$/min, and the injection amount of the acidizing fluid is 20 $m^3$.

Specifically, As illustrated in Table 2, Step S600 is performed in two stages:

In the first stage, the sand-laden fluid and the preflush are alternately injected into the target fracturing interval several times. During a single injection of the sand-laden fluid, the sand ratio of the sand-laden fluid remains unchanged. In the first stage, the sand ratio of the sand-laden fluid is gradually increased from 3% to 8%. The amount of preflush injected is greater than the amount of sand-laden fluid injected. The proppant of the sand-laden fluid is 40/70 mesh ceramsite;

In the second stage, the sand-laden fluid and the preflush are alternately injected into the target fracturing interval several times. During a single injection of the sand-laden fluid, the sand ratio of the sand-laden fluid is increasing. During the second stage, the sand ratio of the sand-laden fluid is spirally increased from 8% to 15%. The amount of preflush injected is less than the amount of sand-laden fluid injected. The proppant of the sand-laden fluid includes 30/50 mesh quartz sand and 20/40 mesh quartz sand. In this embodiment, the proppant of the sand-laden fluid is mainly composed of 30/50 mesh quartz sand, and the 20/40 mesh quartz sand is added in the last several times of injection.

In the first stage, the microfracture system that has been formed in the preflush injection process is further expanded and small size proppant (40/70 mesh ceramsite) is applied to fill various small scale microfracture systems as much as possible. At the same time, it can eliminate the friction of perforation and near-well, as well as communicate and saturate the natural fractures in the near-well section; in the second stage, the high flow rate slick water fracturing fluid is used to satisfy the net pressure required for the fracture with certain half length and width, completely fracturing the main fractures of the far well and communicating the secondary fractures and the micro-natural fractures. In each sand filling process, the sand ratio is increased step by step, and large size proppant (30/50 mesh quartz sand) is used to support the gradually expanding fracture system, and the 20/40 mesh quartz sand is added in the last several times of injection to support the fracture joint, and eventually forming a complex fracture network, resulting a larger reservoir transformation volume.

Specifically, As illustrated in Table 2, In the first stage, a sand-laden fluid is injected into the fracturing interval for six times, wherein the sand ratio of sand-laden fluid injected in the first time is 3%; the sand ratio of sand-laden fluid injected in the second time is 4%; the sand ratio of sand-laden fluid injected in the third time is 5%; the sand ratio of sand-laden fluid injected in the fourth time is 6%; the sand ratio of sand-laden fluid injected in the fifth time is 7%; the sand ratio of sand-laden fluid injected in the sixth time is 8%.

Specifically, As illustrated in Table 2, In the second stage, the sand-laden fluid is injected into the fracturing interval for ten times, wherein, the sand ratio of sand-laden fluid injected in the first time starts at 8% and increases gradually with 1% as a step until it reaches 10%; the sand ratio of sand-laden fluid injected in the second time starts at 8% and increases gradually with 1% as a step until it reaches 10%; the sand ratio of sand-laden fluid injected in the third time starts at 8% and increases gradually with 1% as a step until it reaches 10%; the sand ratio of sand-laden fluid injected in the fourth time starts at 8% and increases gradually with 1% as a step until it reaches 10%; the sand ratio of sand-laden fluid injected in the fifth time starts at 9% and increases gradually with 1% as a step until it reaches 11%; the sand ratio of sand-laden fluid injected in the sixth time starts at 9% and increases gradually with 1% as a step until it reaches 11%; the sand ratio of sand-laden fluid injected in the seventh time starts at 10% and increases gradually with 1% as a step until it reaches 12%; the sand ratio of sand-laden fluid injected in the eighth time starts at 11% and increases gradually with 1% as a step until it reaches 13%; the sand ratio of sand-laden fluid injected in the ninth time starts at 12% and increases gradually with 1% as a step until it reaches 14%; the sand ratio of sand-laden fluid injected in the tenth time starts at 13%, and increases gradually with 1% as a step until it reaches 15%.

TABLE 2

Each injection of sand-laden fluid and the corresponding sand ratio

| | Each Injection of Sand-laden Fluid | Corresponding Sand Ratio | Notes |
|---|---|---|---|
| The First Stage | The 1st time | 3% | Preflush injection amount > Sand-laden fluid injection amount; Proppant: 40/70 mesh ceramsite |
| | The 2nd time | 4% | |
| | The 3rd time | 5% | |
| | The 4th time | 6% | |
| | The 5th time | 7% | |
| | The 6th time | 8% | |
| The Second Stage | The 1st time | 8%-9%-10% | Preflush injection amount < Sand-laden fluid injection amount; Proppant: 30/50 mesh quartz sand with 20/40 mesh quartz sand last several times of injection. |
| | The 2nd time | 8%-9%-10% | |
| | The 3rd time | 8%-9%-10% | |
| | The 4th time | 8%-9%-10% | |
| | The 5th time | 9%-10%-11% | |
| | The 6th time | 9%-10%-11% | |
| | The 7th time | 10%-11%-12% | |
| | The 8th time | 11%-12%-13% | |
| | The 9th time | 12%-13%-14% | |
| | The 10th time | 13%-14%-15% | |

Specifically, As illustrated in Table 3, Interval 1 and Interval 2 are injected with 40/70 mesh ceramsite 15 $m^3$, 30/50 mesh quartz sand 32 $m^3$, 20/40 mesh quartz sand 20 $m^3$; Interval 3-Interval 6 are injected with 40/70 mesh ceramsite 13.5 $m^3$, 30/50 mesh quartz sand 32.5 $m^3$, 20/40 mesh quartz sand 12 $m^3$; Interval 7 and Interval 8 are injected with 40/70 mesh ceramsite 13 $m^3$, 30/50 mesh quartz sand 20 $m^3$, 20/40 mesh quartz sand 12 $m^3$. A total of 110 $m^3$ of 40/70 mesh ceramsite, 234 $m^3$ of 30/50 mesh quartz sand, and 112 $m^3$ of 20/40 mesh quartz sand are injected.

TABLE 3

Injection amount of proppant with different particle sizes in each fracturing interval

| Fracturing Interval | 40/70 Mesh Ceramsite Injection Volume/$m^3$ | 30/50 Mesh Quartz Sand Injection Volume/$m^3$ | 20/40 Mesh Quartz Sand Injection Volume/$m^3$ |
|---|---|---|---|
| Interval 1 | 15 | 32 | 20 |
| Interval 2 | 15 | 32 | 20 |

TABLE 3-continued

Injection amount of proppant with different particle sizes in each fracturing interval

| Fracturing Interval | 40/70 Mesh Ceramsite Injection Volume/$m^3$ | 30/50 Mesh Quartz Sand Injection Volume/$m^3$ | 20/40 Mesh Quartz Sand Injection Volume/$m^3$ |
|---|---|---|---|
| Interval 3 | 13.5 | 32.5 | 12 |
| Interval 4 | 13.5 | 32.5 | 12 |
| Interval 5 | 13.5 | 32.5 | 12 |
| Interval 6 | 13.5 | 32.5 | 12 |
| Interval 7 | 13 | 20 | 12 |
| Interval 8 | 13 | 20 | 12 |
| Total | 110 | 234 | 112 |

Figure 2:
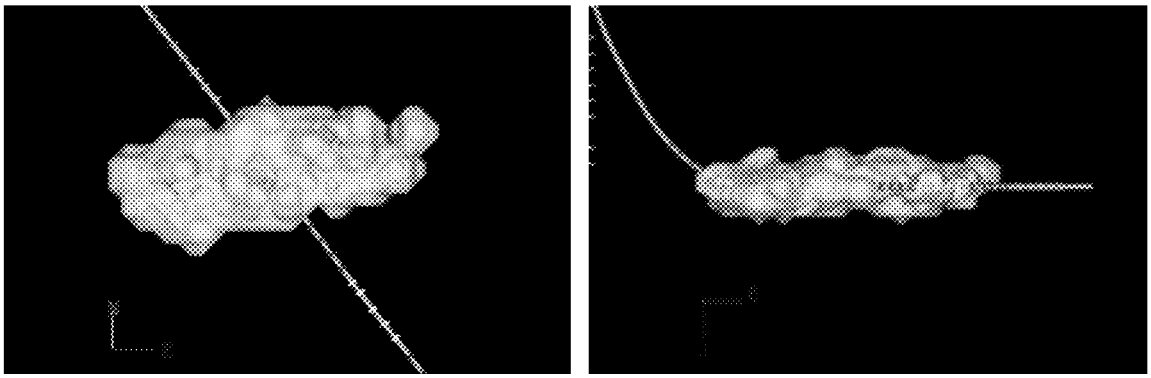
FIG. 2 is the stimulated reservoir volume diagram of the fifth fracturing interval.

By adopting the above fracturing method, complicated fracture system can be formed, and a larger stimulated reservoir volume can be obtained. Taking Interval 5 as an example, the reservoir volume map after the fracturing is shown in FIG. 2, which shows that the fracturing method provided by the this disclosure can effectively increase the complexity of the fracturing network formed by fracturing, which greatly communicates a wide range of oil and gas leakage volume, and fully exploits the production potential of the reservoir. In this embodiment, the stimulated reservoir volume (SRV) is greatly improved, and the stimulated reservoir volume reaches SRV $251.775\times10^4$ $m^3$.

In summary, the volume fracturing method provided by the disclosure increases the pressure of the fracturing fluid by using a low viscosity slick water fracturing fluid with a high flow rate. The stimulated reservoir volume is increased. In addition, by adopting the fracturing method, the complexity of the stimulated reservoir by fracturing is effectively improved, and the effect of increasing the production of the reservoir is further improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. Slick water volumetric fracturing method with large liquid volume, high flow rate, large preflush and low sand ratio, suitable for low-permeability tight sandstone reservoir, including the following steps:

(a) dividing a compressible reservoir into several fracturing intervals, wherein the reservoir is determined to be compressible by evaluating reservoir parameters and determining the compressibility of the reservoir;

(b) determining a perforation position and perforation parameters of one of the fracturing intervals, wherein the perforation parameters include at least cluster spacing, number of clusters, number of perforations, and perforation density;

(c) determining fracturing parameters, wherein the fracturing parameters includes flow rate and injection volume of preflush, sand-laden fluid, and displacement fluid of each fracturing interval;

(d) performing a perforation operation on one of the fracturing intervals based on the determined position of the perforation and the determined perforation parameters;

(e) injecting acidizing fluids into the perforations formed in Step (d) to acidify the perforations;

(f) alternately injecting preflush and sand-laden fluids into one of the fracturing intervals several times to fracture fractures and fill sand into the fractures;

(g) after the sand filling is completed, injecting displacement fluids into the fracturing interval to drive the sand-laden fluids in a wellbore into the fractures;

wherein the flow rate in Step (c) is not less than 12 m3/min; a sand ratio of the sand-laden fluid is not more than 15%; the preflush and the displacement fluids are slick water fracturing fluids, and the sand-laden fluids are slick water fracturing fluids with proppant added; the amount of preflush injection is 30% to 50% of the total injection volume of the fracturing fluids.

2. The slick water volumetric fracturing method according to claim 1, wherein the number of the fracturing intervals is eight, a fracturing interval spacing is 60~80 meters, the cluster spacing is 20 meters, the number of perforations per cluster is eight, the perforation density is eight holes per meter, and a flow rate of fluid in each of the holes is not less than 0.3 $m^3$/min.

3. The slick water volumetric fracturing method according to claim 1, wherein the acidizing fluid is 15% hydrochloric acid with other additives, a flow rate of the acidizing fluid is 2 $m^3$/min, and an injection amount of the acidizing fluid is 20 $m^3$.

4. The slick water volumetric fracturing method according to claim 1, wherein Step (f) is performed in two stages, which includes:

in the first stage, the sand-laden fluid and the preflush are alternately injected into a target fracturing interval formed in Step (c) several times, during a single injection of the sand-laden fluid, the sand ratio of the sand-laden fluid remains unchanged, in the first stage, the sand ratio of the sand-laden fluid is gradually increased from 3% to 8%, the amount of preflush injected is greater than the amount of sand-laden fluid injected, the proppant of the sand-laden fluid is 40/70 mesh ceramsite;

in the second stage, the sand-laden fluid and the preflush are alternately injected into the target fracturing interval formed in Step (c) several times, during a single injection of the sand-laden fluid, the sand ratio of the sand-laden fluid is increasing, during the second stage, the sand ratio of the sand-laden fluid is spirally increased from 8% to 15%, the amount of preflush injected is less than the amount of sand-laden fluid injected, the proppant of the sand-laden fluid includes 30/50 mesh quartz sand and 20/40 mesh quartz sand.

5. The slick water volumetric fracturing method according to claim 4, wherein the first stage, a sand-laden fluid is injected into the fracturing interval for six times, wherein the sand ratio of sand-laden fluid injected in the first time is 3%; the sand ratio of sand-laden fluid injected in the second time is 4%; the sand ratio of sand-laden fluid injected in the third time is 5%; the sand ratio of sand-laden fluid injected in the fourth time is 6%; the sand ratio of sand-laden fluid injected in the fifth time is 7%; the sand ratio of sand-laden fluid injected in the sixth time is 8%.

6. The slick water volumetric fracturing method according to claim 4, wherein the second stage, the sand-laden fluid is injected into the fracturing interval for ten times, wherein, the sand ratio of sand-laden fluid injected in the first time starts at 8% and increases gradually with 1% as a step until it reaches 10%; the sand ratio of sand-laden fluid injected in the second time starts at 8% and increases gradually with 1% as a step until it reaches 10%; the sand ratio of sand-laden fluid injected in the third time starts at 8% and increases gradually with 1% as a step until it reaches 10%; the sand ratio of sand-laden fluid injected in the fourth time starts at 8% and increases gradually with 1% as a step until it reaches 10%; the sand ratio of sand-laden fluid injected in the fifth time starts at 9% and increases gradually with 1% as a step until it reaches 11%; the sand ratio of sand-laden fluid injected in the sixth time starts at 9% and increases gradually with 1% as a step until it reaches 11%; the sand ratio of sand-laden fluid injected in the seventh time starts at 10% and increases gradually with 1% as a step until it reaches 12%; the sand ratio of sand-laden fluid injected in the eighth time starts at 11% and increases gradually with 1% as a step until it reaches 13%; the sand ratio of sand-laden fluid injected in the ninth time starts at 12% and increases gradually with 1% as a step until it reaches 14%; the sand ratio of sand-laden fluid injected in the tenth time starts at 13%, and increases gradually with 1% as a step until it reaches 15%.

7. The slick water volumetric fracturing method according to claim 1, wherein a formulation of the slick water is: 0.1% drag reducing agent+0.2% anti-swelling agent+0.2% cleanup additive+0.05% bactericide+99.45% water.

* * * * *